US006299003B1

(12) United States Patent
Osorio

(10) Patent No.: US 6,299,003 B1
(45) Date of Patent: Oct. 9, 2001

(54) DISHWASHING RACK

(76) Inventor: Angel R. Osorio, Ferguson Straat 36A PO Box 1172, Oranjestad (AW)

( * ) Notice: Subject to any disclaimer, the term of this patent is extended or adjusted under 35 U.S.C. 154(b) by 0 days.

(21) Appl. No.: 09/591,070

(22) Filed: Jun. 9, 2000

(51) Int. Cl.[7] ..... A47F 5/14
(52) U.S. Cl. ..... 211/181.1
(58) Field of Search ..... 211/181.1, 41.2, 211/41.1, 41.3, 41.4, 41.5, 41.6, 175

(56) References Cited

U.S. PATENT DOCUMENTS

| | | | | |
|---|---|---|---|---|
| D. 120,494 | | 5/1940 | Watral . | |
| D. 217,491 | | 5/1970 | Wooters . | |
| 839,906 | * | 1/1907 | Timberlake | 211/41.2 |
| 910,057 | * | 1/1909 | Greener | 211/41.2 |
| 1,163,038 | * | 12/1915 | Robertson et al. | 211/181.1 |
| 2,010,734 | | 8/1935 | Parker . | |
| 2,225,681 | * | 12/1940 | Braun | 211/181.1 |
| 3,789,996 | * | 2/1974 | Stroh | 211/181.1 |
| 3,800,957 | | 4/1974 | Krause . | |
| 4,531,641 | | 7/1985 | Archambault . | |
| 4,694,966 | * | 9/1987 | Sorenson et al. | 211/181.1 |
| 4,865,821 | * | 9/1989 | Langdon | 211/181.1 |
| 4,969,560 | | 11/1990 | Stanfield . | |

* cited by examiner

*Primary Examiner*—Alvin Chin-Shue
*Assistant Examiner*—Sarah Purol

(57) ABSTRACT

A dishwashing rack for making it easier to wash dishes without breaking them. The dishwashing rack includes a frame having side members, a top member integrally attached to the side members, a bottom member also integrally attached to the side members, and a plurality of cross members interconnecting the side members; and also includes a plurality of elongate dish support members being mounted at a slant upon the frame with each elongate dish support member having a bottom end portion which is angled to prevent dishes from sliding off the dishwashing rack; and further includes extendable leg members each having an elongate leg support member securely attached to the frame, a tubular leg member slidably mounted upon the elongate leg support member, and a threaded member threaded through a side of the tubular leg member and being engageable to the elongate leg support member; and also includes detachable mounting members for attaching the dishwashing rack to a side wall of a sink.

12 Claims, 2 Drawing Sheets

DISHWASHING RACK

BACKGROUND OF THE INVENTION

1. Field of the Invention

The present invention relates to a washing rack for dishes and more particularly pertains to a new dishwashing rack for making it easier to wash dishes without breaking them.

2. Description of the Prior Art

The use of a washing rack for dishes is known in the prior art. More specifically, washing, rack for dishes heretofore devised and utilized are known to consist basically of familiar, expected and obvious structural configurations, notwithstanding the myriad of designs encompassed by the crowded prior art which have been developed for the fulfillment of countless objectives and requirements .

Known prior art includes U.S. Pat. Nos. 4,969,560; 2,010,734; U.S. Patent No. Des. 120,494; U.S. Pat. Nos. 4,531,641; 3,800,957; and U.S. Patent No. Des. 217,491.

While these devices fulfill their respective, particular objectives and requirements, the aforementioned patents do not disclose a new dishwashing rack. The inventive device includes a frame having side members, a top member integrally attached to the side members, a bottom member also integrally attached to the side members, and a plurality of cross members interconnecting the side members; and also includes a plurality of elongate dish support members being mounted at a slant upon the frame with each elongate dish support member having a bottom end portion which is angled to prevent dishes from sliding off the dishwashing rack; and further includes extendable leg members each having an elongate leg support member securely attached to the frame, a tubular leg member slidably mounted upon the elongate leg support member, and a threaded member threaded through a side of the tubular leg member and being engageable to the elongate leg support member; and also includes detachable mounting members for attaching the dishwashing rack to a side wall of a sink.

In these respects, the dishwashing rack according to the present invention substantially departs from the conventional concepts and designs of the prior art, and in so doing provides an apparatus primarily developed for the purpose of making it easier to wash dishes without breaking them.

SUMMARY OF THE INVENTION

In view of the foregoing disadvantages inherent in the known types of washing rack for dishes now present in the prior art, the present invention provides a new dishwashing rack construction wherein the same can be utilized for making it easier to wash dishes without breaking them.

The general purpose of the present invention, which will be described subsequently in greater detail, is to provide a new dishwashing rack which has many of the advantages of the washing rack for dishes mentioned heretofore and many novel features that result in a new dishwashing rack which is not anticipated, rendered obvious, suggested, or even implied by any of the prior art washing rack for dishes, either alone or in any combination thereof.

To attain this, the present invention generally comprises a frame having side members, a top member integrally attached to the side members, a bottom member also integrally attached to the side members, and a plurality of cross members interconnecting the side members; and also includes a plurality of elongate dish support members being mounted at a slant upon the frame with each elongate dish support member having a bottom end portion which is angled to prevent dishes from sliding off the dishwashing rack; and further includes extendable leg members each having an elongate leg support member securely attached to the frame, a tubular leg member slidably mounted upon the elongate leg support member, and a threaded member threaded through a side of the tubular leg member and being engageable to the elongate leg support member; and also includes detachable mounting members for attaching the dishwashing rack to a side wall of a sink.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dishwashing rack which has many of the advantages of the washing rack for dishes mentioned heretofore and many novel features that result in a new dishwashing rack which is not anticipated, rendered obvious, suggested, or even implied by any of the prior art washing rack for dishes, either alone or in any combination thereof.

It is another object of the present invention to provide a new dishwashing rack which may be easily and efficiently manufactured and marketed.

It is a further object of the present invention to provide a new dishwashing rack which is of a durable and reliable construction.

An even further object of the present invention is to provide a new dishwashing rack which is susceptible of a low cost of manufacture with regard to both materials and labor, and which accordingly is then susceptible of low prices of sale to the consuming public, thereby making such dishwashing rack economically available to the buying public.

Still yet another object of the present invention is to provide a new dishwashing rack which provides in the apparatuses and methods of the prior art some of the advantages thereof, while simultaneously overcoming some of the disadvantages normally associated therewith.

Still another object of the present invention is to provide a new dishwashing rack for making it easier to wash dishes without breaking them.

Yet another object of the present invention is to provide a new dishwashing rack which includes a frame having side members, a top member integrally attached to the side members, a bottom member also integrally attached to the side members, and a plurality of cross members interconnecting the side members; and also includes a plurality of elongate dish support members being mounted at a slant upon the frame with each elongate dish support member having a bottom end portion which is angled to prevent dishes from sliding off the dishwashing rack; and further includes extendable leg members each having an elongate leg support member securely attached to the frame, a tubular leg member slidably mounted upon the elongate leg support member, and a threaded member threaded through a side of the tubular leg member and being engageable to the elongate leg support member; and also includes detachable mounting members for attaching the dishwashing rack to a side wall of a sink.

Still yet another object of the present invention is to provide a new dishwashing rack that safeguards the dishes when they are being washed.

Even still another object of the present invention is to provide a new dishwashing rack that can be conveniently attached and detached to the sink when needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
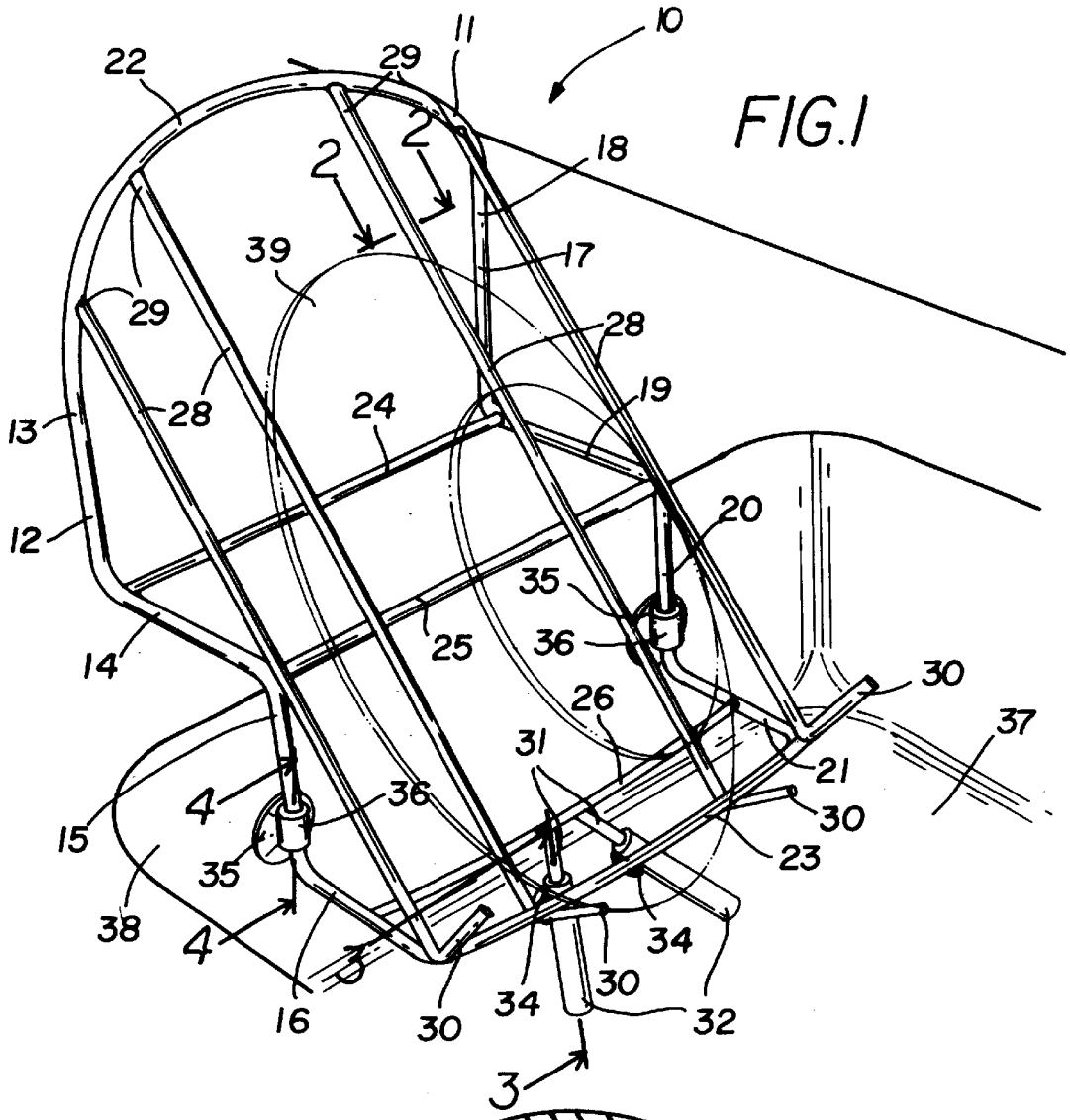
FIG. 1 is a perspective view of a new dishwashing rack according to the present invention.
Figure 2:
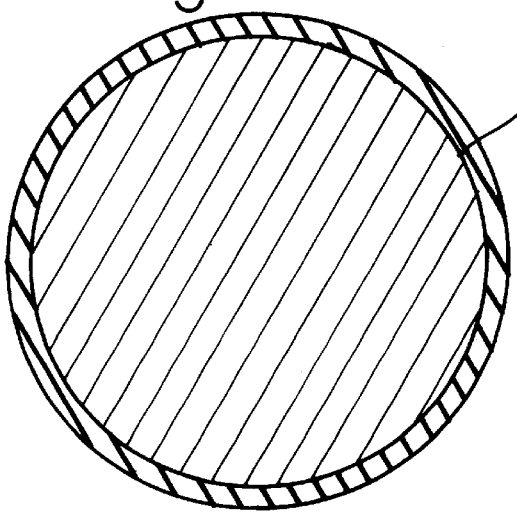
FIG. 2 is a cross-sectional view of one of the members of the frame of the present invention.
Figure 3:
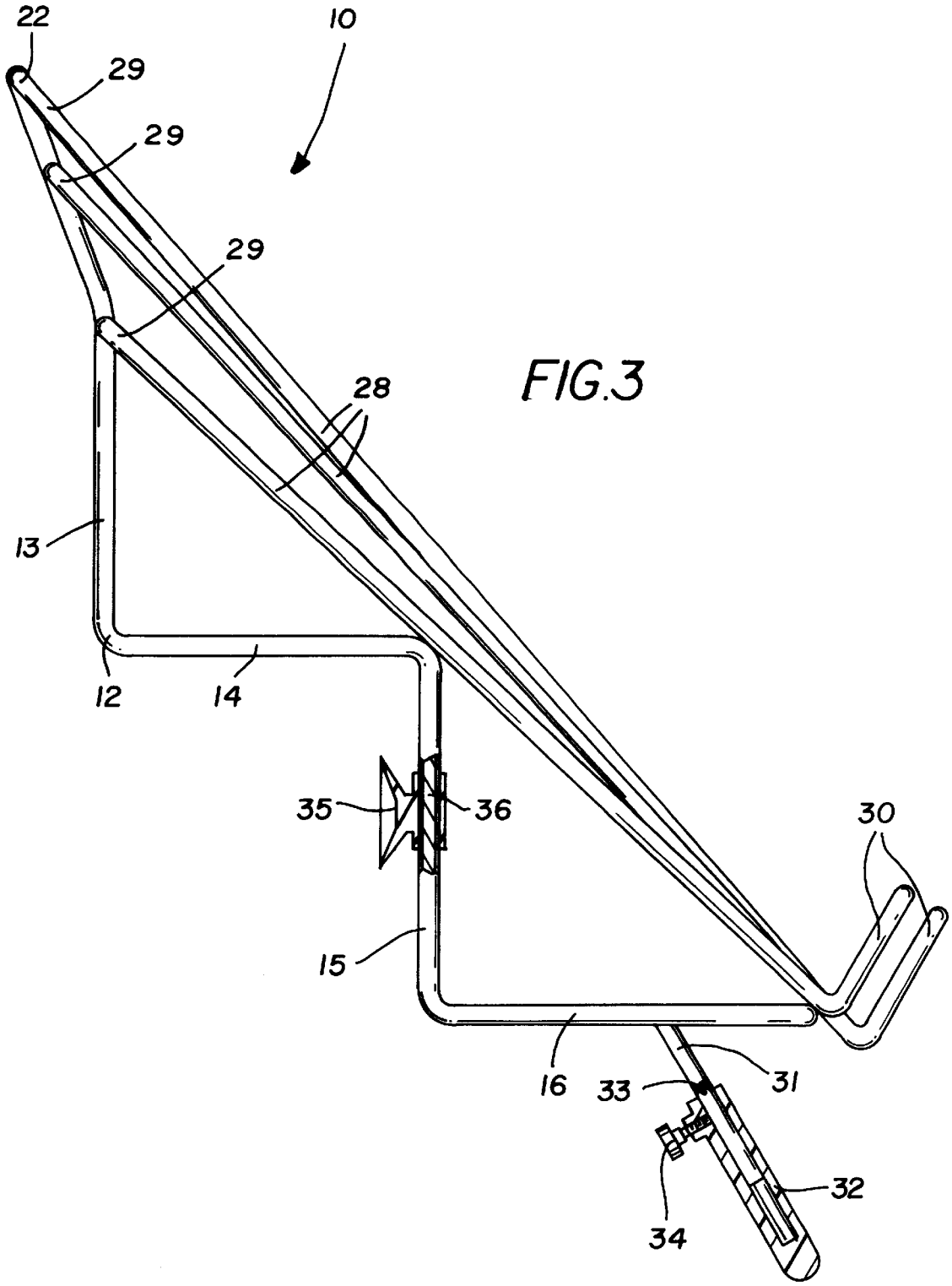
FIG. 3 is a side elevational view of the present invention.

With reference now to the drawings, and in particular to FIGS. 1 through 3 thereof, a new dishwashing rack embodying the principles and concepts of the present invention and generally designated by the reference numeral 10 will be described.

As best illustrated in FIGS. 1 through 3, the dishwashing rack 10 generally comprises a frame 11 having a front, a back, side members 12,17, a top member 22 integrally attached to the side members 12,17, a bottom member 23 also integrally attached to the side members 12,17, and cross members 24–26 conventionally interconnecting and extending between the side members 12,17. Each of the side members 12,17 includes a lower portion 16,21 which is generally horizontally disposed, and also includes an upper portion 13,18 which is generally vertically disposed, and further includes a lower intermediate portion 15,20 which is disposed generally perpendicular to the lower portion 16,21, and also includes an upper intermediate portion 14,19 which is disposed perpendicular to the upper portion 13,18 and to the lower intermediate portion 16,21. The top member 22 of the frame 11 is angled upwardly and rearwardly relative to the side members 12,17 of the frame 11. The cross members 24–26 include a bottom cross member 26 which conventionally interconnects and extends between the lower portions 16,21 of the side members 12,17.

A plurality of elongate dish support members 28 are spaced apart and securely and conventionally attached to the frame 11. Each of the elongate dish support members includes a main portion, a top end 29 which is securely attached to the top member 22 of the frame 11, and further includes a bottom end portion 30 which is angled generally perpendicular to the main portion and which is adapted to support dishes 39 thereupon with the elongate dish support members 28 being slanted downwardly and forwardly from the top member 22 to the bottom member 23 of the frame 11. The bottom end portions 30 of the elongate dish support members 28 are angled upwardly and forwardly of the frame 11. The frame 11 and the elongate dish support members 28 are coated with a rubberized material to prevent marking up the sink 37.

A plurality of extendable leg members are suspended from the frame 11. Each of the extendable leg members includes an elongate leg support member 31 having a top end securely and conventionally attached and welded to the bottom cross member 26. The elongate leg support member 31 extends downwardly from the bottom cross member 26. Each of the extendable leg members also includes a tubular leg member 32 having an open end 33 and being slidably mounted about the elongate leg support member 31, and further includes a threaded member 34 threaded through a side of the tubular leg member 32 and being engageable to the elongate leg support member 31 to secure the tubular leg member 32 at a selected position along the elongate support member 31. Each of the extendable leg members is disposed generally perpendicular to the bottom cross member 26 and is angled downwardly and forwardly relative to the frame 11.

A plurality of detachable mounting members are securely mounted to the frame 11 and are adapted to detachably mount the dishwashing rack 10 to a side wall 38 of a sink 37. Each of the detachable mounting members includes a suction cup 35 and a sleeve 36 securely and conventionally attached to the suction cup 35 and is mounted about a respective one of the side members 12,17 of the frame 11 with the suction cup 35 being adapted to detachably attach to the side wall 38 of a sink 37. The dishwashing rack 10 has a height of approximately 14 inches and a width of approximately 8 to 12 inches.

In use, the user positions the dishwashing rack 10 with the lower intermediate portions 15,20 and the lower portions 16,21 of the side members 12,17 being disposed in the sink 37 and the detachable mounting members being securely attached to a side wall 38 of the sink 37. Dishes 39 such as plates are placed upon the elongate dish support members 28 and can be easily sprayed off with water to essentially clean the dishes 39.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dishwashing rack comprising:

a frame having a front, a back, side members, a top member integrally attached to said side members, a bottom member also integrally attached to said side members, and cross members interconnecting and extending between said side members;

a plurality of elongate dish support members being spaced apart and securely attached to said frame;

a plurality of extendable leg members being suspended from said frame; and a plurality of detachable mounting members securely mounted to said frame and being adapted to detachably mount said dishwashing rack to a wall of a sink.

2. A dishwashing rack as described in claim 1, wherein each of said side members includes a lower portion which is generally horizontally disposed, an upper portion which is generally vertically disposed, a lower intermediate portion which is disposed generally perpendicular to said lower portion, and an upper intermediate portion which is disposed perpendicular to said upper portion and to said lower intermediate portion.

3. A dishwashing rack as described in claim 2, wherein said top member of said frame is angled upwardly and rearwardly relative to said side members of said frame.

4. A dishwashing rack as described in claim 3, wherein said cross members includes a bottom cross member which interconnects and extends between said lower portions of said side members.

5. A dishwashing rack as described in claim 4, wherein each of said elongate dish support members includes a main portion, a top end which is securely attached to said top member of said frame, and further includes a bottom end portion which is angled generally perpendicular to said main portion and which is adapted to support dishes thereupon.

6. A dishwashing rack as described in claim 5, wherein said elongate dish support members are slanted downwardly and forwardly from said top member to said bottom member of said frame.

7. A dishwashing rack as described in claim 6, wherein said bottom end portions of said elongate dish support members are angled upwardly and forwardly of said frame.

8. A dishwashing rack as described in claim 7, wherein each of said extendable leg members includes an elongate leg support member having a top end securely attached to said bottom cross member, said elongate leg support member extending downwardly from said bottom cross member; and also includes a tubular leg member having an open end and being slidably mounted about said elongate leg support member; and further includes a threaded member threaded through a side of said tubular leg member and being engageable to said elongate leg support member to secure said tubular leg member at a selected position along said elongate support member.

9. A dishwashing rack as described in claim 8, wherein each of said extendable leg members is disposed generally perpendicular to said bottom cross member and is angled downwardly and forwardly relative to said frame.

10. A dishwashing rack as described in claim 9, wherein each of said detachable mounting members includes a suction cup and a sleeve securely attached to said suction cup and being mounted about a respective one of said side members of said frame, said suction cup being adapted to detachably attach to the side wall of a sink.

11. A dishwashing rack as described in claim 10, wherein said frame and said elongate dish support members are coated with a rubberized material to prevent marking up the sink.

12. A dishwashing rack comprising:

a frame having a front, a back, side members, a top member integrally attached to said side members, a bottom member also integrally attached to said side members, and cross members interconnecting and extending between said side members, each of said side members including a lower portion which is generally horizontally disposed, an upper portion which is generally vertically disposed, a lower intermediate portion which is disposed generally perpendicular to said lower portion, and an upper intermediate portion which is disposed perpendicular to said upper portion and to said lower intermediate portion, said top member of said frame being angled upwardly and rearwardly relative to said side members of said frame, said cross members including a bottom cross member which interconnects and extends between said lower portions of said side members;

a plurality of elongate dish support members being spaced apart and securely attached to said frame, each of said elongate dish support members including a main portion, a top end which is securely attached to said top member of said frame, and further including a bottom end portion which is angled generally perpendicular to said main portion and which is adapted to support dishes thereupon, said elongate dish support members being slanted downwardly and forwardly from said top member to said bottom member of said frame, said bottom end portions of said elongate dish support members being angled upwardly and forwardly of said frame, said frame and said elongate dish support members being coated with a rubberized material to prevent marking up the sink;

a plurality of extendable leg members being suspended from said frame, each of said extendable leg members including an elongate leg support member having a top end securely attached to said bottom cross member, said elongate leg support member extending downwardly from said bottom cross member; and also including a tubular leg member having an open end and being slidably mounted about said elongate leg support member; and further including a threaded member threaded through a side of said tubular leg member and being engageable to said elongate leg support member to secure said tubular leg member at a selected position along said elongate support member, each of said extendable leg members being disposed generally perpendicular to said bottom cross member and being angled downwardly and forwardly relative to said frame; and a plurality or detachable mounting members securely mounted to said frame and being adapted to detachably mount said dishwashing rack to a wall of a sink, each of said detachable mounting members including a suction cup and a sleeve securely attached to said suction cup and being mounted about a respective one of said side members of said frame, said suction cup being adapted to detachably attach to the side wall of a sink, said dishwashing rack having a height of approximately 14 inches and a width of approximately 8 to 12 inches.

* * * * *